United States Patent [19]

Heaney

[11] 4,127,765

[45] Nov. 28, 1978

[54] ANTI-CONDENSATION SYSTEM FOR REFRIGERATOR DOORS

[75] Inventor: James J. Heaney, Glendale, Calif.

[73] Assignee: Anthony's Manufacturing Company, Inc., San Fernando, Calif.

[21] Appl. No.: 878,692

[22] Filed: Feb. 17, 1978

[51] Int. Cl.[2] ..... H05B 1/00

[52] U.S. Cl. ..... 219/218; 49/70; 62/248; 62/150; 219/522

[58] Field of Search ..... 219/218, 522; 62/275, 62/148, 176, 150, 248; 49/70; 52/275, 171, 173

[56] References Cited

U.S. PATENT DOCUMENTS

| | | | |
|---|---|---|---|
| 2,858,408 | 10/1958 | Barroero | 219/218 X |
| 3,724,129 | 4/1973 | Stromquist | 49/70 |
| 3,859,502 | 1/1975 | Heaney | 219/218 |

*Primary Examiner*—C. L. Albritton

*Attorney, Agent, or Firm*—Kleinberg, Morganstern, Scholnick & Mann

[57] ABSTRACT

A system is described which permits the electrically heated door of a refrigerated display cabinet to be operated selectively at a plurality of power settings, providing respectively higher and lower levels of electrical heating. A switching means is used to alter the electrical interconnection of the door window heating elements with the door frame heating elements from a series connection to a parallel connection. In one embodiment, an automatic electrical controller actuates the switch in response to changes in the ambient humidity and temperature.

9 Claims, 6 Drawing Figures

14
20
22
24
20
22
12
16
2
2
18
18
16

3
34
32
36
42
44
3
18
48
50
38
46
30
40

ANTI-CONDENSATION SYSTEM FOR REFRIGERATOR DOORS

BACKGROUND OF THE INVENTION

1. Field of the Invention

The present invention relates to refrigerated display cabinets and more particularly to an electrically heated door structure for use in such cabinets.

2. The Prior Art

In U.S. Pat. No. 3,724,129 to Stromquist, the use of an optically transparent electrically conductive coating for preventing moisture condensation on the front-most glazed surface of a refrigerated cabinet door window is described. Such coatings, normally applied to the unexposed surface of the frontmost glass pane are currently in wide use. The amount of heating normally supplied typically ranges from ten to fifteen watts per square foot of window area. Once the door is fabricated, the electrical resistance of the door window heating coating is fixed.

In a typical door structure, the multi-paned window is surrounded by a metallic door frame. To prevent condensation and frost from forming on the door frame, it is known in the art to provide electrical heating elements concealed within a groove within the door frame structure. Normally, once the heating element in the door frame has been installed, its electrical resistance is also fixed.

Theoretically, the heating elements both on the glass and in the door frame could be preselected before the door is built to have heating characteristics suitable for the anticipated environment in which the door will be used. However, as a practical matter, this practice complicates the manufacturing and inventorying of such doors. Further, the use of preselected heating elements of constant resistance normally provides only limited ability to cope with environments which may vary widely.

Controllers are known in the prior art for applying the electrical heating current intermittently, the duty cycle typically depending upon the relative humidity of the ambient air. These controllers do not alter the resistance of the heating elements and as a result, a high resistance door operated in a very humid environment might prove to be inadequate even though the controller maintains the current "on" 100% of the time. In such a case, if the high resistance door is replaced by a lower resistance door, a wasteful overheating of the door may occur.

Prior to the present invention, it has been known to connect the heating element in the door frame to the window heating element in either series or parallel connection depending on the environment in which the door would be operated. Parallel-wired doors were used in high-humidity environments, while series wired doors were used in less demanding environments. Once a door had been built, it was thereafter referred to as a series-wired door or a parallel-wired door, and the interconnection was not thereafter alterable without disassembling the door to a considerable degree.

As a result, it was necessary to inventory both parallelwired doors and series-wired doors both for original installations and for replacement use.

Because doors carried in inventory are unproductive investments, it is desirable to reduce inventory levels to the lowest practical point.

SUMMARY OF THE INVENTION

Inventory levels can be substantially reduced through the addition to each refrigerator door of an inexpensive switching means which is easy to wire. This switching circuit is installed when the door is built and thereafter provides the capability of setting the current flowing through the door frame and window heater elements at either a higher level or a lower level. Thus, a single door so equipped can be used in either a high humidity environment which previously required the use of a parallel-wired door, or in a normal humidity environment which previously required a door that was series-wired.

In a preferred embodiment, the switching means can be actuated to alter the interconnection of the window heating element and the door frame element from a series connection to a parallel connection, and vice versa. Thus, for one position of the switch the heating elements are connected in series, while for another position of the switch, the heating elements are connected in parallel. The only additional component required is an inexpensive switch.

In a preferred embodiment, the switch is manually operated, since ambient conditions of humidity and temperature usually do not vary rapidly. In other embodiments a controller can be used to actuate the switch in response to sensed changes in the ambient humidity, dew point, temperature, or combinations thereof.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
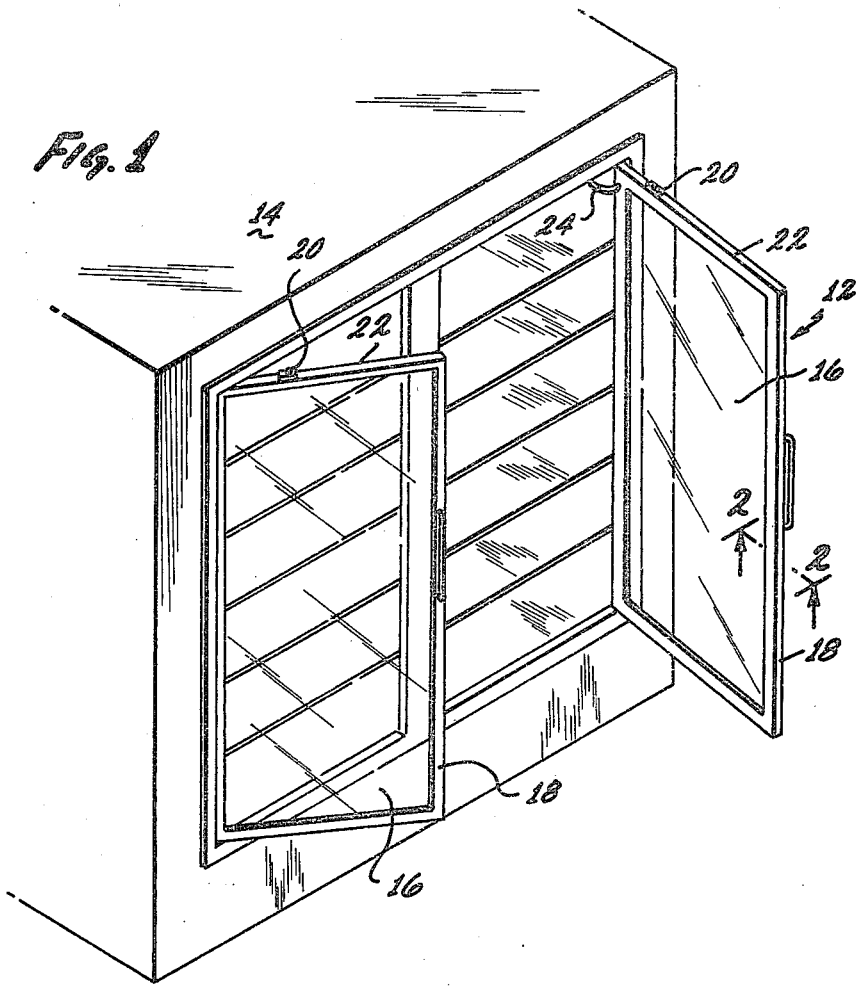
FIG. 1 is a perspective view showing a refrigerated display cabinet and the type of door in which the present invention may advantageously be applied.

Referring now to the FIGS., there is shown in FIG. 1 a door 12 of a refrigerated cabinet 14. The door 12 includes a window portion 16 and a door frame portion 18. In accordance with the present invention, an electrical switch 20 is preferably mounted in the door frame along the upper surface of its upper horizontal member 22 as shown in FIG. 1. Electrical power to operate the resistive heating elements of the present invention is supplied to the door through cable 24.

Figure 2:
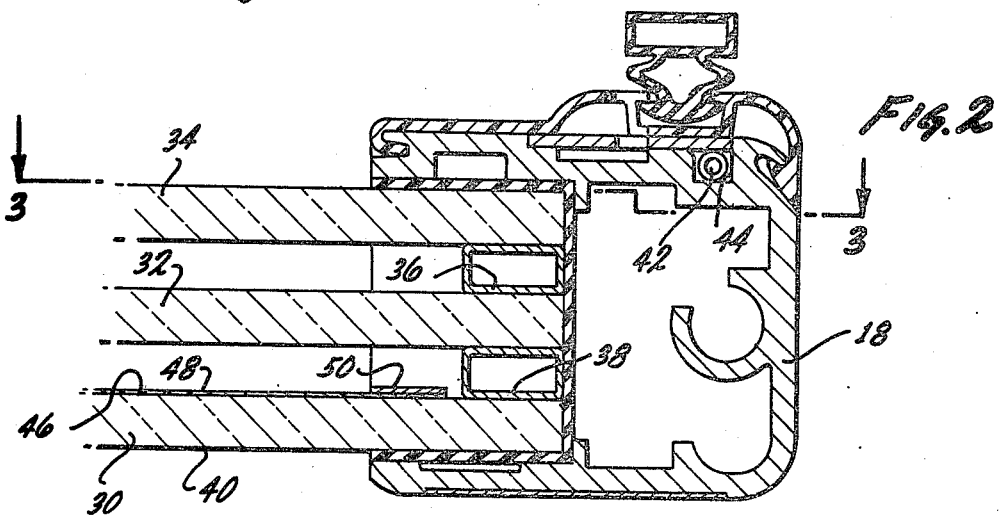
FIG. 2 is an enlarged cross-sectional view taken in the direction of the arrows 2—2 of FIG. 1.

FIG. 2 is a cross-sectional view of the door frame in the direction 2—2 shown in FIG. 1. In a typical door, the window 16 comprises two or more transparent panes such as the panes 30, 32, 34 of glass which are spaced apart by the spacers 36, 38 and are clamped together by the channel-like door frame 18.

When the door is in the closed position, the front surface 40 of pane 30 as well as portions of the door frame 18 are exposed to the moisture-bearing air outside the refrigerated cabinet. It is those portions on which condensation or frost would normally form in the absence of electrical heating.

To prevent the formation of condensation, the door frame 18 is heated by suitable heating means such as the electrical heating element 42. Heating element 42 is preferably an insulated resistive conductor contained within a groove 44 in the door frame 18. The inward facing surface 46 of pane 30 is coated with an optically transparent electrically conductive coating 48. A metallic strip electrode 50 is preferably supplied along two opposite sides of the conductive coating 48 to distribute the applied electrical current uniformly across the width of the window heating element 48, and to facilitate electrical connection to the conductive coating in a manner known to the art.

Figure 3:
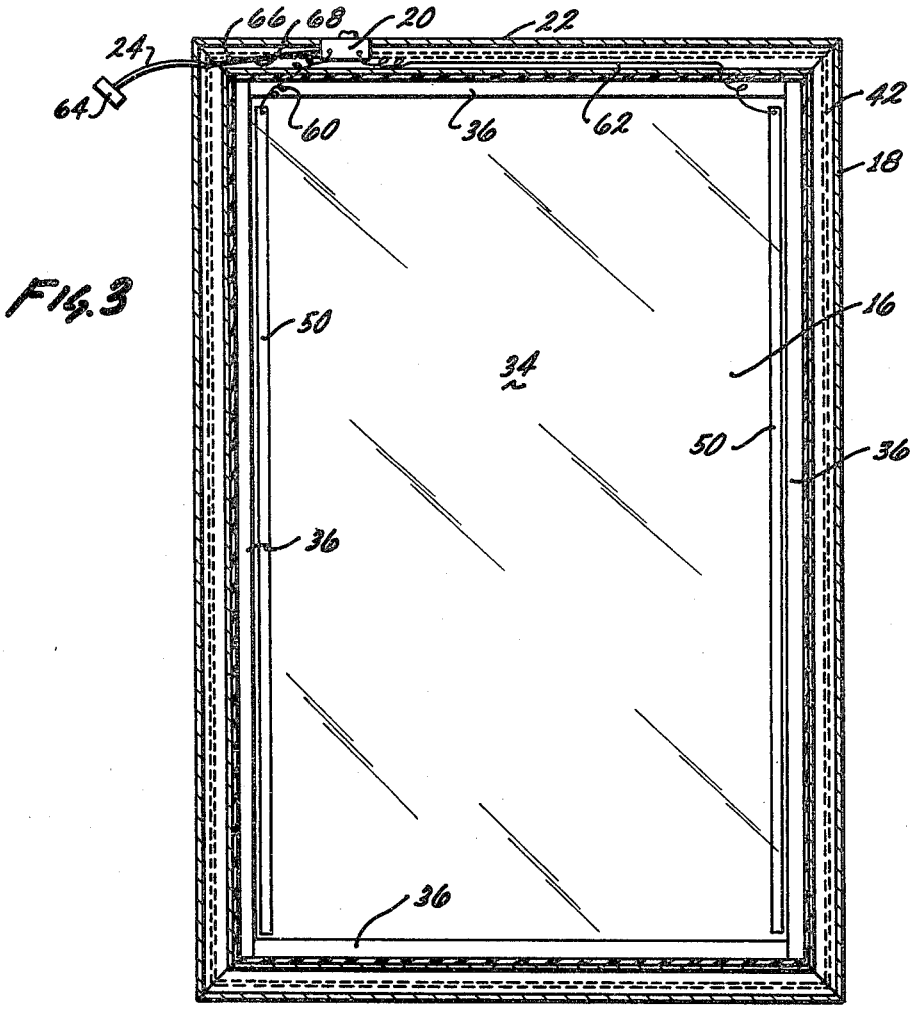
FIG. 3 is a plan view showing the inward facing surface of a refrigerated cabinet door with portions removed to show the location of the heating elements and connecting wires.

FIG. 3 shows how the metallic strip electrodes 50 of the window heating element and the heater wire 42 in the door frame 18 are electrically connected to the other parts of the system. In accordance with the present invention, lead wires 60, 62 connect the metallic strip electrodes with the switch 20. The ends of the door frame element 42 also are connected to the switch 20. Power for the electrical heating elements is applied to the door through the plug 64 and the cable 24. The cable preferably contains a ground wire which is connected to the door frame for safety purposes. Cable 24 further comprises current-carrying wires 66, 68 which are connected to the switch 20. The detailed electrical connections are shown more clearly in the preferred embodiment of FIG. 4, wherein like reference numerals refer to like parts. The switch 20 is seen to be preferably a double-pole double-throw switch which is manually actuated in the preferred embodiment. The terminals 76 and 78 are connected by a conductor 80. Switch 20 may also be a double-pole triple-throw switch having an "off" position wherein power is removed from the heating elements.

Figure 5:
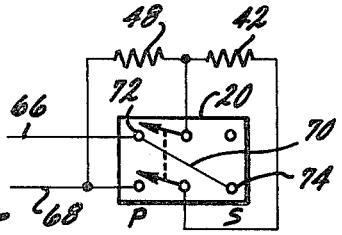
FIG. 5 is a circuit diagram of an alternative embodiment of the switching circuit according to the present invention; and, FIG. 6 is a circuit diagram of an alternative embodiment wherein a controller is used to automatically actuate the switching circuit.

The circuit diagram of FIG. 5 shows an alternative embodiment of the present invention. In the embodiment of FIG. 5, a conductor 70 connects the switch terminals 72 and 74.

Figure 4:
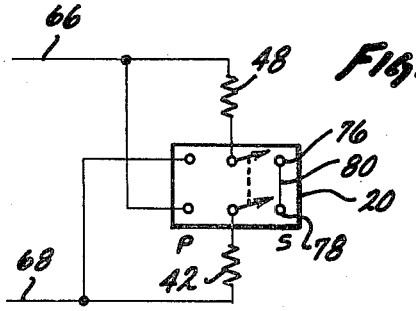
FIG. 4 is a circuit diagram of the switching circuit of a preferred embodiment of the present invention.
Figure 6:
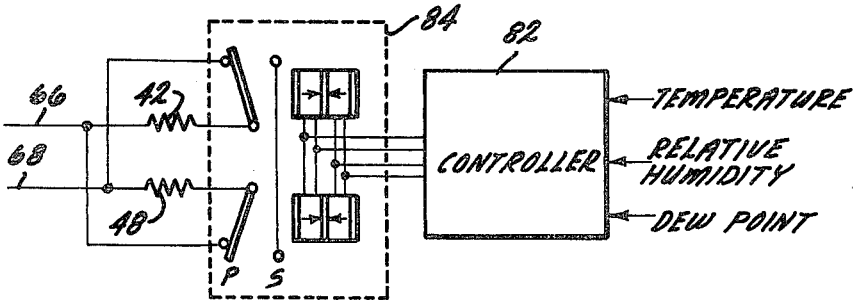

FIG. 6 shows an alternative embodiment of the present invention and includes a controller 82 for actuating the switching element. In the embodiment of FIG. 6, the electrical switching circuit configuratin of FIG. 4 is employed, but the double-pole double-throw switch 20 has been replaced by a differential relay 84, indicated by the dashed lines. Clearly, in yet other embodiments, semiconductor switching circuits or other suitable circuitry could be employed if desired.

While FIG. 4 shows a switch which could be manually operated, and FIG. 6 shows a switching circuit which can be electromagnetically actuated, it is clear that in other embodiments desired switching could be actuated by mechanical, photoelectric or other suitable means. The controller 82 of FIG. 6 includes suitable sensors (now shown) for detecting ambient conditions such as the relative humidity or dew point of the air outside the refrigerated cabinet adjacent the door. The sensors' outputs may be converted by any suitable known means to electrical signals which are functionally related to the sensed parameter. These signals function to actuate relay 84 by any suitable known circuitry included within controller 82 to switch the door heating system from one heating mode to another. Controller 82 may thus be automatically actuated by selectively utilizing desired sensed ambient or door conditions. One suitable controller is described in Heaney U.S. Pat. No. 3,859,502.

Thus, there has been shown a switching circuit for use with electrically heated door of a refrigerated cabinet. The switching circuit permits the normally present window heater element and the door frame heater element to be selectively connected either in series or in parallel. The electrical resistance of the parallel combination is always less than the electrical resistance of the series combination. Therefore, when the combination is connected to a current source of substantially constant voltage V, a greater current flows through the heater elements when they are connected in parallel than when they are connected in series. As a result, greater heating is applied in the parallel configuration, enabling a single refrigerator door to be used in both normal and high humidity environments without substantial modification.

In accordance with Ohn's law, the current flowing through conductor 66 when the door frame heater element 42 and the window heater element 48 are connected in parallel is $Ip=V/Rp$ where V is the applied line voltage, and when they are connected in series the current is $I_s=V/Rs$ Since the power dissipated when a current I flows through a resistance R is $I^2R$, in the parallel-connected case the total power dissipated is $P_p = I_p^2R_p = V^2(1/Rp) = V^2(1/R_1 + 1/R_2)$ where $R_1$ is the resistance of the heater element 42 and $R_2$ is the resistance of resistive film 48. In the series-connected case, the total power dissipated is $P_s = I_s^2R_s = V^2/R_s = V^2/R_1 + R_2$ In general $P_p/P_s = (R_1 + R_2)^2/R_1 R_2$ which has a minimum value of 4 when $R_1 = R_2$ Thus, when the connection of the heating elements is altered according to the present invention, from series to parallel, the heating power is increased by a factor of four, at least.

In conclusion, there has been described a novel switching circuit which through the addition of suitable switching means permits the door to be selectively operated as a series-wired door or a parallel-wired door. This cuts inventory requirements substantially and permits the doors, when installed, to be altered electrically to cope with widely varying ambient conditions.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. For use with a refrigerator door having an electrically heated door frame including a door frame heating element and an electrically heated window including a window heating element to prevent condensation and frost from forming, apparatus for providing variable levels of heating, comprising:

switching means electrically connectable to the door frame electrical heating element and to the window electrical heating element for selectively altering the manner in which said door frame electrical heating element and said window electrical heating element are electrically interconnected from a series connection to a parallel connection, to alter the effective electrical resistance of the combination of said door frame and window electrical heating elements, whereby a plurality of levels of heating are selectively obtainable when the combination is connected across a voltage source of electrical current.

2. The apparatus of claim 1 wherein said switching means comprises a double-pole double-throw switch.

3. The apparatus of claim 1 wherein said switching means further comprises a selectable "off" setting at which the flow of electrical current through said door frame and window heating elements is prevented.

4. The apparatus of claim 3 wherein said switching means further comprises a double-pole triple-throw switch.

5. The apparatus of claim 1 wherein said switching means is manually actuated.

6. The apparatus of claim 1 further comprising control means connected to said switching means said control means including means for sensing the dew point of the air outside the refrigerator adjacent the refrigerator door and for producing and applying to said switching means signals to actuate it in response to predetermined changes in the sensed dew point.

7. The apparatus of claim 1 further comprising control means connected to said switching means for sensing the humidity of the air outside the refrigerator adjacent the refrigerator door, and for producing and applying to said switching means signals to actuate it in response to predetermined changes in the sensed humidity.

8. The apparatus of claim 1 further comprising control means connected to said switching means for sensing the temperature of a part of the refrigerator door, and for producing and applying to said switching means signals to actuate it in response to predetermined changes in the sensed temperature.

9. For use with a refrigerator door having a door frame and a window, the door frame having an electrical door frame heating element for warming it and the window having an electrical window heating element for warming it, the improvement comprising an electrical switch for selectively connecting the door frame heating element and the window heating element in either series or in parallel connection.

* * * * *